United States Patent [19]

Kohler et al.

[11] 4,030,057

[45] June 14, 1977

[54] INDUCTIVE VOLTAGE TRANSFORMER

[75] Inventors: Werner Kohler; Willi Müller, both of Berlin, Germany

[73] Assignee: Siemens Aktiengesellschaft, Munich, Germany

[22] Filed: Apr. 28, 1976

[21] Appl. No.: 681,114

Related U.S. Application Data

[63] Continuation of Ser. No. 507,574, Sept. 19, 1974, abandoned.

[30] Foreign Application Priority Data

Sept. 24, 1973 Germany ..... 2348397

[52] U.S. Cl. ..... 336/83; 336/174

[51] Int. Cl.[2] ..... H01F 15/02

[58] Field of Search ..... 336/173, 174, 175, 83, 336/84; 323/44 R; 307/98, 104

[56] References Cited

UNITED STATES PATENTS

| | | | |
|---|---|---|---|
| 1,471,263 | 10/1923 | Hobart | 336/83 X |
| 2,567,394 | 9/1951 | Nutlman | 336/83 |
| 2,878,425 | 3/1959 | Kudoh | 336/83 X |
| 2,948,871 | 8/1960 | Craipe | 336/83 |
| 2,962,679 | 11/1960 | Stratton | 336/83 |
| 3,609,613 | 9/1971 | Horn et al. | 336/83 |

FOREIGN PATENTS OR APPLICATIONS

| | | | |
|---|---|---|---|
| 213,236 | 6/1956 | Australia | 336/83 |

*Primary Examiner*—Thomas J. Kozma
*Attorney, Agent, or Firm*—Kenyon & Kenyon Reilly Carr & Chapin

[57] ABSTRACT

An inductive voltage transformer disposable between a high-voltage potential and a low-voltage potential has a first flux-conductive part surrounded by a high-voltage winding having a surface facing away from the flux-conductive part. A low-voltage winding is arranged at this surface of the high-voltage winding. A second flux-conductive part made of magnetically-conductive material is disposed in spaced relation to the first flux-conductive art so as to be adjacent thereto. Flux-conductive intermediate members connect the parts together to conjointly define therewith a cup-like core structure enclosing the high-voltage and low-voltage windings therein. The cup-like core is connectable to the high-voltage potential and the intermediate members are made of a material that is magnetically-conductive while at the same time being electrically insulative.

17 Claims, 5 Drawing Figures

INDUCTIVE VOLTAGE TRANSFORMER

This is a continuation of application Ser. No. 507,574, filed Sept. 19, 1974, now abandoned.

BACKGROUND OF THE INVENTION

The invention relates to an inductive voltage transformer having a high-voltage winding which surrounds a flux-conduction piece of a core connected to a high-voltage potential and having a low-voltage winding arranged at the surface of the high-voltage winding that is facing away from the above-mentioned flux-conduction piece of the core.

Deutsche Offenlegungsschrift Nos. 1,638,345 and 1,638,539 disclose an inductive voltage transformer of this general type wherein one flux-conduction piece forms a leg of a core, the other legs are free of windings; this construction yields a comparatively large transformation ratio error which is caused by the relatively large stray inductance.

SUMMARY OF THE INVENTION

It is an object of the invention to provide an inductive voltage transformer having a small transformation ratio error and therefore a higher transmission accuracy.

The inductive voltage transformer according to the invention includes as a feature a first flux-conductive part and a second flux-conductive part made of magnetically-conductive material arranged opposite to the first part; these parts and connecting elements which connect the two flux-conductive parts conjointly define a cup-shaped core in which a high-voltage winding and a low-voltage winding are enclosed. The connecting elements are made of magnetically-conductive material which is also electrically insulating.

The advantage of the inductive voltage transformer according to the invention is found primarily in the fact that the cup-shaped core enclosing the high-voltage and the low-voltage windings causes the stray inductance to be kept comparatively small whereby the transformation ratio error of the voltage transformer remains small.

A further advantage of the voltage transformer according to the invention is that it affords a comparatively compact configuration and therefore facilitates its use where tight space conditions prevail.

The voltage transformer of the invention can be constructed in different ways by providing appropriate configurations and arrangements of the flux-conductive parts and the connecting elements which connect the two flux-conductive parts. It is, however, considered to be advantageous to make the first flux-conductive part of the core cylindrical and that it be surrounded by the other flux-conductive part which is likewise cylinder-shaped. The flux-conductive parts are then in the area of their end-faces connected with each other by means of connecting elements which are configured as ring-shaped discs. This embodiment of the voltage transformer of the invention is particularly well suited for use in metal-clad high-voltage switching installations when the voltage transformer is to be arranged in-line with the switching installation. The inductive voltage transformer of the invention can in this case, with appropriate choice of dimensions, be pushed over the inner conductor of the high-voltage switching installation and is then arranged as a disc-like component between the high-voltage conductor and the grounded outer tube of the switching installation.

Another rather well suited embodiment of the voltage transformer of the invention for use in metal-clad high-voltage switching installations provides that the first flux-conductive part of the iron core be a flux-conductive ring with a U-profile and that the second flux-conductive part of the core be a further flux-conductive ring with a U-profile. The U-profile type flux-conductive rings are arranged to face each other with their open sides with mutual insulation against high-voltage provided by means of connecting elements shaped as insulating rings. The advantage of this form of embodiment of the voltage transformer of the invention is the fact that an essential portion of the core is made of a magnetically highly conductive material, for instance of iron, whereas only the comparatively narrow insulating rings consist of a material which is magnetically conductive but is nonetheless electrically insulating. Compared to iron, this material exhibits an inferior magnetic conductivity. Particularly of advantage for this embodiment of the voltage transformer of the invention is the provision of circular lateral ribs on the insulating rings which serve to extend the surface-leakage path. Additionally and for the same reason, discs of insulating material are solidly mounted on the inside of the connecting elements; these discs extending laterally beyond the connecting elements.

A prerequisite for the use of such a voltage tranformer according to the invention in metal-clad high-voltage switching installations is that the first ring with a U-profile is surrounded by the other ring with a U-profile so that the voltage can be taken down in the radial direction as is required in metal-clad high-voltage switching installations.

Flux-conductive pieces with a U-profile can be used in another embodiment of the voltage transformer according to the invention wherein the voltage is taken down in the direction of the longitudinal axis of the transformer. In this embodiment of the voltage transformer, the flux-conductive parts with U-profile are configured as flux-conductive rings which are identically shaped. Between the flux-conductive parts are then disposed cylinder-shaped connecting elements arranged concentrically. The high-voltage and the low-voltage windings are arranged in axial direction one behind the other within the ring-shaped space formed by the flux-conductive parts and the cylindrical connecting elements.

Still another embodiment of the voltage transformer of the invention includes the first flux-conductive part of the core and the second flux-conductive part configured as discs which are connected on the outside and the inside by means of connecting elements shaped as insulating cylinders. For this embodiment of the voltage transformer of the invention and as a departure from the embodiment described above, no rings with U-profile are used but only discs which afford a simpler production.

To avoid eddy currents, it is advantageous to slit the flux-conductive parts and the connecting elements in those voltage transformers that are intended for use in metal-clad high-voltage switching installations and through which the current conductors go that carry the voltage to be measured.

Although the invention is illustrated and described herein as an inductive voltage transformer, it is nevertheless not intended to be limited to the details shown, since various modifications may be made therein within the scope and the range of the claims. The invention, however, together with additional objects and advantages will be best understood from the following description and in connection with the accompanying drawings.

DESCRIPTION OF THE PREFERRED EMBODIMENTS OF THE INVENTION

Figure 1:
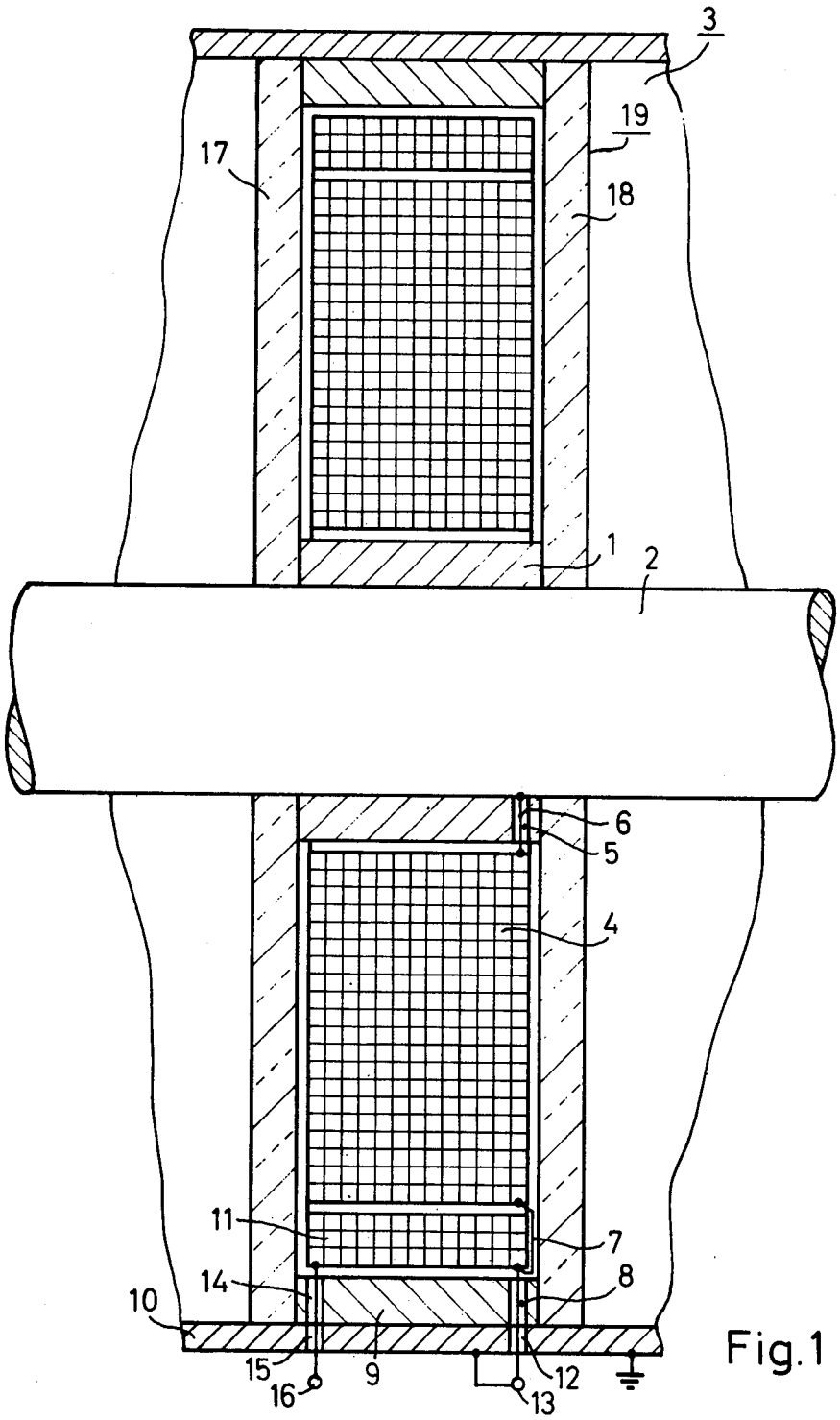
FIG. 1 is a schematic diagram, partially in section, of the inductive voltage transformer according to the invention. The voltage transformer is shown mounted in a metal-clad high-voltage switching installation.

The voltage transformer depicted in FIG. 1 has a cylindrical flux-condition piece 1 which surrounds a high-voltage conductor 2 of a metal-clad high-voltage switching installation 3. On the flux-conduction piece 1 is disposed a high-voltage winding 4 which is connected with its high-voltage end 6 to the high-voltage conductor 2, the connection being made through a passage hole 5 for example. The low-voltage end 7 of the high-voltage winding 4 is connected through a further passage hole 8 in another cylindrical flux-conduction piece 9 to an outer tube 10 of the high-voltage switching installation 3.

A low-voltage winding 11 surrounds the high-voltage winding 4 and is connected with its one end to the low-voltage end 7 of the high-voltage winding 4 and thus likewise brought to the outside through the passage hole 8 in the further flux-conduction piece 9 and through an opening 12 in the outer tube 10 of the high-voltage switching installation 3 to a terminal 13 connected to the outer tube 10. The other end of the winding of the low-voltage winding 11 is brought through another passage hole 14 and an opening 15 in the outer tube 10 to a further output terminal 16. At the terminals 13 and 16 is then available a voltage which is proportional to the voltage between the high-voltage conductor 2 and the outer tube 10 of the high-voltage switching installation 3.

For completing the magnetic circuit there are provided besides the flux-conduction piece 1 and the other flux-conduction piece 9, connecting elements 17 and 18 in the form of disks which respectively interconnect the flux-conduction pieces 1 and 9 at their end faces. Since the connecting elements 17 and 18 are under high-voltage stress, they are made of electrically insulating material. Since they must also be magnetically conductive, a material which is electrically insulating but magnetically conducting, for instance, barium-ferrite is used in their production.

In the voltage transformer illustrated in FIG. 1 and according to the invention, the two flux conducting pieces 1 and 9 and the connecting elements 17 and 18 will thus form a cup-shaped core 19, in which the high-voltage winding 4 and the low-voltage winding 11 are enclosed. The stray inductance of this voltage transformer is thus small and, hence the transformation ratio error is also small.

Figure 2:
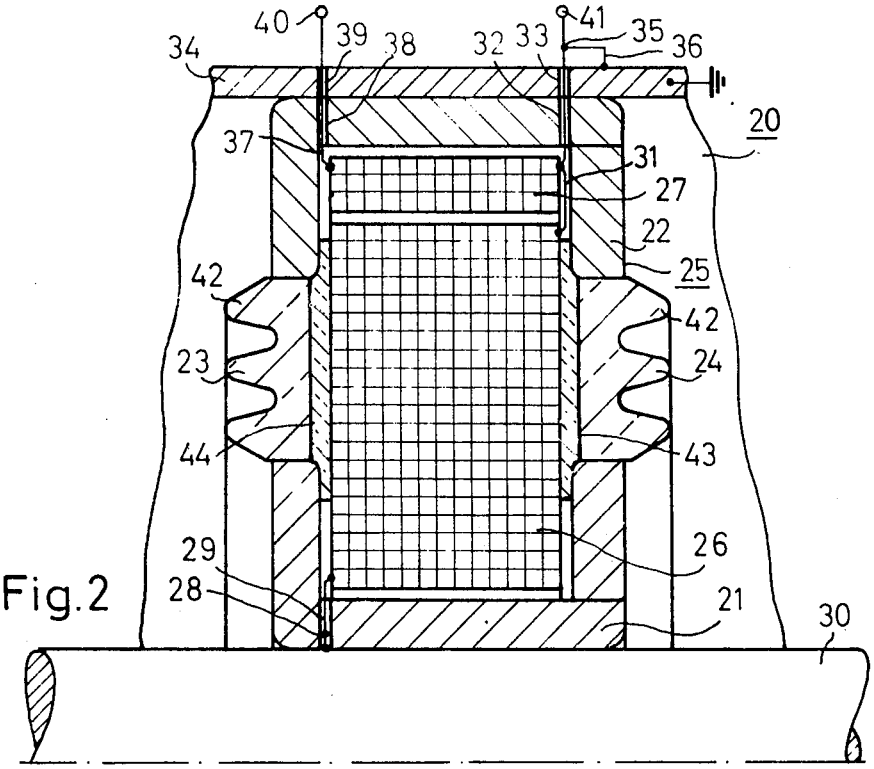
FIG. 2 is a half-section elevation view of another embodiment of a voltage transformer according to the invention which is likewise adapted for use in metal-clad high-voltage switching installations.

In the embodiment of the voltage transformer according to the invention shown in FIG. 2 which also is especially suited for use in a metal-clad high-voltage switching installation 20, the one flux-conduction piece 21 and the other flux-conduction piece 22 are configured as flux conduction rings with a U-profile. The flux-conduction pieces 21 and 22 are arranged concentrically to each other in such a way that they face each other with their open areas. Between each of the flux-conduction pieces 21 and 22 is arranged a connecting element 23 and 24 shaped in the form of an insulation ring. The flux-conduction pieces 21 and 22 and the connecting elements 23 and 24 which again consist of magnetically conductive, electrically insulating material thus make up a cup-shaped core 25 in which a high-voltage winding 26 is accommodated adjacent to the flux-conduction piece 21 and a low-voltage winding 27 adjacent to the other flux-conduction piece 22. The high-voltage end 28 of the high-voltage winding 26 is brought through a passage hole 29 to the high-voltage conductor 30 of the high-voltage switching installation 20 and is connected to it. The low-voltage end 31 of the high-voltage winding 26 is brought through a passage hole 32 in the other flux-conduction piece 22 and through an opening 33 in the outer tube 34 of the high-voltage switching installation 20 to a circuit point 35. The circuit point 35 is connected with the outer tube 34 by a conductor 36.

The one end 37 of the low-voltage winding 27 is brought through a passage hole 38 in the other flux-conduction piece 22 and through a further opening 39 in the outer tube 34 to a terminal 40. In a corresponding manner, another end of the low-voltage winding 27 is brought through another passage hole 32 in the flux-conduction piece 22 and through a further opening 33 to a terminal 41. The other end of the low-voltage winding 27 is connected with the winding end 31 of the high-voltage winding 26 and brought to an exterior terminal 41. Therefore, at the terminals 40 and 41, a voltage can be taken off which is proportional to the voltage between the high-voltage conductor 30 and the outer tube 34 of the high-voltage switching installation 20.

Ribs 42 on the connecting elements 23 and 24 extend the surface-leakage path and thus to avoid a breakdown between the flux-conduction pieces 21 and 22. Insulating disks 43 and 44 serve the same purpose.

Figure 3:
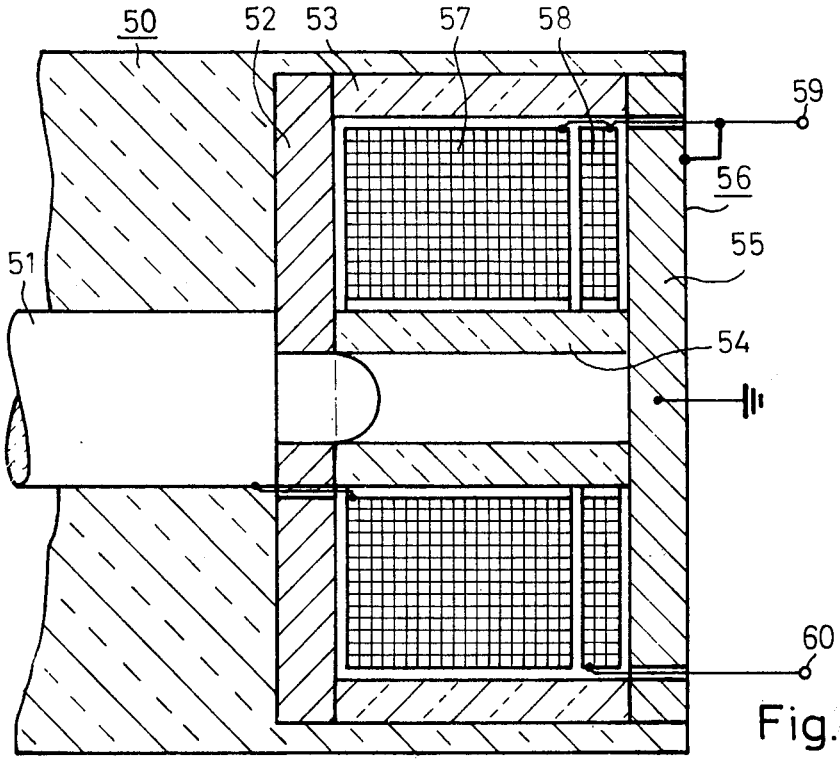
FIG. 3 is an alternate embodiment of the voltage transformer according to the invention; this embodiment is configured as an open-air voltage transformer.

The embodiment of the voltage transformer illustrated in FIG. 3 can be used by itself, separated from a high-voltage switching installation; it may, however, also be flanged to the end of a high-voltage switching installation. The voltage transformer is therefore arranged at the end of a bushing 50 through which a high-voltage conductor 51 is guided. The high-voltage conductor 51 is connected with a flux-conduction piece 52 which represents a ring disk in the illustrated embodiment. A connecting piece 53 in the form of an outer cylinder and another connecting piece 54 in the form of an inner cylinder make up, conjointly with another flux-conduction piece 55 in the form of a disc, a cup-shaped core 56 in which are accommodated a high-voltage winding 57 and a low-voltage winding 58.

The connections of the high-voltage winding 57 and the low-voltage winding 58 to the high-voltage on the one hand, and to the low-voltage on the other hand, can be made in a similar manner as already described in connection with the embodiments of FIGS. 1 and 2. At the ends 59 and 60 of the low-voltage winding 58, a voltage can therefore be taken off which corresponds to the voltage between the high-voltage conductor 51 and the grounded flux-conduction piece 55.

Figure 4:
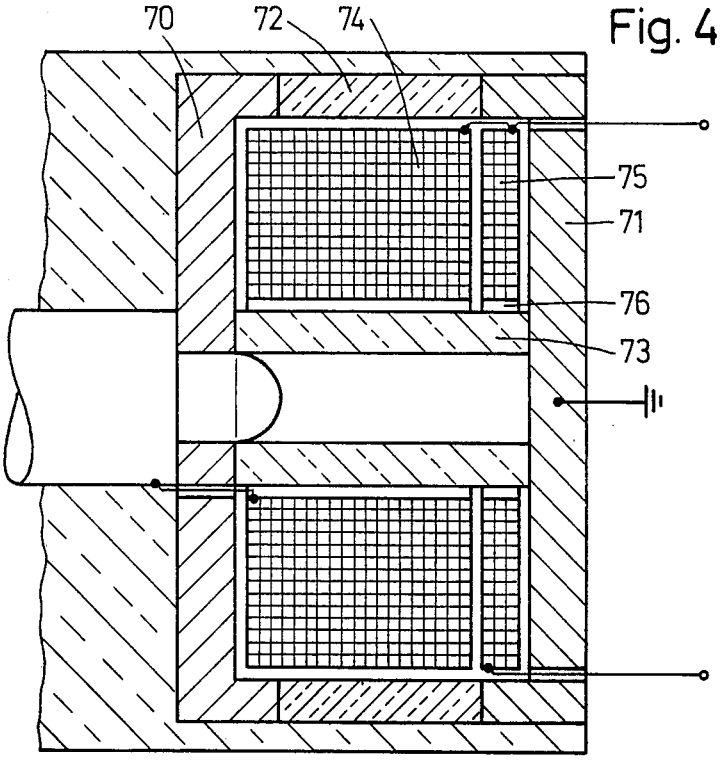
FIG. 4 is an alternate embodiment of the voltage transformer according to the invention wherein the voltage is taken down in the direction of the longitudinal axis of the transformer.

FIG. 4 shows how flux-conductive piece having a U-shaped profile can be arranged in a voltage current transformer wherein the voltage is taken down in a direction of the longitudinal axis of the transformer. In this embodiment, flux-conductive parts 70 and 71 each have a U-profile and are configured as flux-conductive rings having identical shapes. Between the flux-conductive parts 70 and 71 are disposed cylinder-shaped connecting elements 72 and 73 arranged concentrically. The high-voltage winding 74 and the low-voltage winding 75 are arranged in axial direction one behind the other within the ring-shaped space 76 conjointly defined by the conductive parts 70 and 71 and the cylindrical connecting elements 72 and 73.

Figure 5:
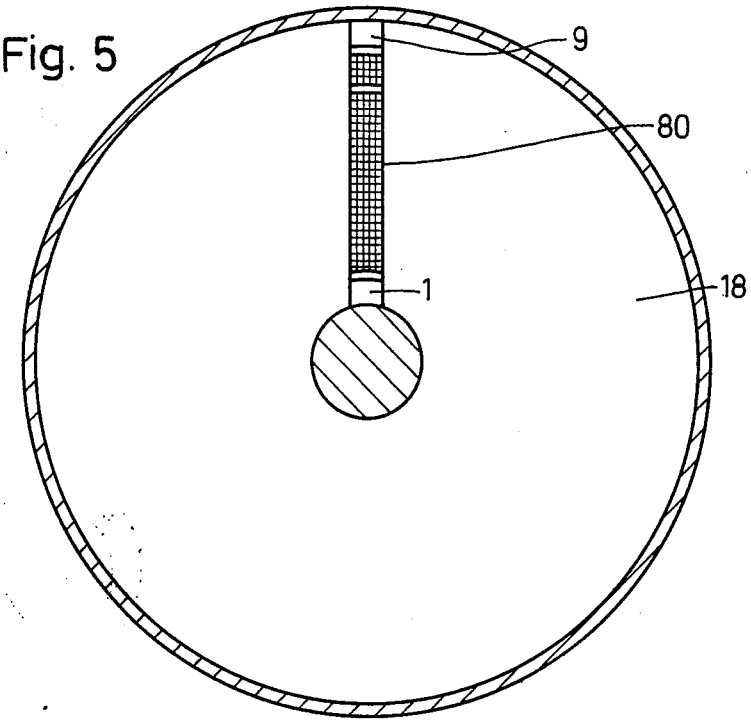
FIG. 5 illustrates the voltage transformer shown in FIG. 1 wherein the flux-conductive parts and connecting elements are provided with slits for minimizing eddy currents.

FiG. 5 shows how the embodiment according to FIG. 1 can be configured to avoid eddy currents. The flux-conductive parts 1 and 9 as well as the connecting elements 17 and 18 are provided with slits 80.

The invention realizes an inductive voltage transformer which by utilizing a cup-shaped core with a high-voltage and a low-voltage winding accommodated inside the core, exhibits a small stray inductance and thus also a small transformation ratio error.

What is claimed is:

1. In a metal-clad, high-voltage installation having a metal enclosure at low potential and a conductor for carrying a high potential disposed within the metal enclosure, an inductive voltage transformer disposed between the potentials of the metal enclosure and the conductor, the inductive voltage transformer comprising: a first flux-conductive part made of electrically and magnetically-conductive material and electrically connected to the conductor of the installation; a high-voltage winding surrounding said first flux-conductive part and having a surface facing away from said flux-conductive part; a low-voltage winding arranged at said surface of said high-voltage winding; a second flux-conductive part electrically connected to the metal enclosure and made of electrically and magnetically-conductive material, said second flux conducting part being disposed in spaced relation to said first flux-conductive part so as to be adjacent thereto; and flux-conductive intermediate means extending between said potentials for connecting said parts together to conjointly define therewith a composite core enclosing said high-voltage and said low-voltage windings therein thereby reducing the stray inductance of said windings, said intermediate means being made of a material that is magnetically conductive while at the same time being electrically insulative thereby preventing a conductor to enclosure fault through said intermediate means during the operation of the high-voltage installation.

2. The inductive voltage transformer of claim 1, said flux-conductive intermediate means being two intermediate members and joining said parts together to conjointly define therewith said cup-like core.

3. The inductive voltage transformer of claim 2, said first part defining a passage for accommodating a conductor therein carrying the high-voltage potential.

4. The inductive voltage transformer of claim 2 comprising rib means formed on said intermediate members for increasing the voltage creep path between said potentials.

5. The inductive voltage transformer of claim 1, said first flux-conductive part being cylindrically configured and having respective longitudinal end-faces; said second flux-conductive part being cylindrically configured and also having respective longitudinal end-faces; said second flux-conductive part being disposed in surrounding relation to said first flux-conductive part; and said flux-conductive intermediate means being two ring-shaped discs, each one of said discs being joined to a corresponding end-face on each of said parts to connect said parts together.

6. The inductive voltage transformer of claim 5, the opening in said ring-shaped discs and in said first flux-conductive part conjointly defining a passage for accommodating a conductor carrying the high-voltage potential.

7. The inductive voltage transformer of claim 5, said first and second flux-conductive parts and said ring-shaped discs all having slits extending in a direction transverse to the planes of said ring-shaped discs whereby eddy currents are minimized.

8. The inductive voltage transformer of claim 5, rib means formed on said ring-shaped discs for increasing the voltage creep path between said potentials.

9. The inductive voltage transformer of claim 1, said first flux-conductive part being a ring-shaped part having a U-shaped profile, said second flux-conductive part also being a ring-shaped part having a U-shaped profile, said parts being arranged so as to cause the respective open ends thereof to be mutually adjacent; and, said flux-conductive intermediate means being two intermediate ring members, each one of said ring members being joined to a corresponding leg of each of said parts to connect said parts together while at the same time providing high-voltage insulation therebetween.

10. The inductive voltage transformer of claim 9, the opening of said first flux-conductive part being adapted to accommodate therein a conductor carrying the high-voltage potential.

11. The inductive voltage transformer of claim 9, each of said intermediate ring members having rib means formed thereon for increasing the creep path between said potentials.

12. The inductive voltage transformer of claim 11 comprising ring-shaped discs of insulating material disposed adjacent corresponding ones of said intermediate ring members, each one of said discs being configured so as to extend laterally beyond the inner and outer edges of the corresponding intermediate ring member.

13. The inductive voltage transformer of claim 9, said first and second ring-shaped parts and said intermediate ring members all having slits extending in a direction transverse to the planes of said ring-shaped members whereby eddy currents are minimized.

14. The inductive voltage transformer of claim 9, said second flux-conductive part being arranged in surrounding relation to said first flux-conductive part.

15. The inductive voltage transformer of claim 1, said first and second flux-conductive parts being first and second ring-shaped members respectively, said ring-shaped members each having a U-shaped profile and being configured one like the other; and, said flux-conductive intermediate means comprising two mutually concentric cylindrical intermediate members extending between said ring-shaped members so as to conjointly define therewith an annular space, said high-voltage winding and said low-voltage winding being arranged in said annular space one behind the other in the axial direction of the transformer.

16. The inductive voltage transformer of claim 1, said first and second flux-conductive parts being respective disc members; and, said flux-conductive intermediate means comprising an inner cylinder disposed between said disc members, and an outer cylinder disposed in surrounding relation to said inner cylinder, each one of said cylinders being joined to a corresponding region of each of said disc members to connect said disc members together while at the same time providing high-voltage insulation therebetween.

17. The inductive voltage transformer of claim 16, one of said disc members being adapted for connection to a conductor carrying the high-voltage potential.

* * * * *